US006394762B1

(12) United States Patent
Collingborn et al.

(10) Patent No.: US 6,394,762 B1
(45) Date of Patent: May 28, 2002

(54) FUEL PUMP

(75) Inventors: Peter Alban George Collingborn; John Roderick Jefferson, both of Gillingham; Christopher Stringfellow, Sittingbourne, all of (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/635,946

(22) Filed: Aug. 10, 2000

(30) Foreign Application Priority Data

Aug. 11, 1999 (GB) ..... 9918810

(51) Int. Cl.[7] ..... F04B 25/00; F01B 9/00

(52) U.S. Cl. ..... 417/254; 417/255; 123/516; 92/129; 92/138

(58) Field of Search ..... 92/129, 138; 417/251, 417/254, 255, 267; 123/516

(56) References Cited

U.S. PATENT DOCUMENTS

| | | | | |
|---|---|---|---|---|
| 3,059,579 A | * | 10/1962 | Bessiere | 417/244 |
| 3,781,144 A | * | 12/1973 | Jacobs | 417/525 |
| 4,565,501 A | * | 1/1986 | Laurendeau et al. | 417/267 |
| 5,456,159 A | * | 10/1995 | Brackett | 92/138 |
| 5,701,872 A | | 12/1997 | Kaku et al. | 123/495 |
| 6,068,448 A | * | 5/2000 | Muratsubaki et al. | 417/44.2 |
| 6,116,146 A | * | 9/2000 | Steffes | 92/72 |

FOREIGN PATENT DOCUMENTS

| | | |
|---|---|---|
| EP | 0856661 | 8/1998 |
| GB | 743758 | 1/1956 |
| GB | 1274237 | 5/1972 |
| WO | 9922134 | 5/1999 |

OTHER PUBLICATIONS

European Search Report Dated Sep. 25, 2001.

* cited by examiner

*Primary Examiner*—Charles G. Freay
(74) *Attorney, Agent, or Firm*—Thomas A. Twomey

(57) ABSTRACT

A fuel pump comprising a first pumping plunger reciprocable within a first bore and defining, with the first bore, a first pumping chamber. A second pumping plunger is reciprocable within a second bore and defines, with the second bore, a second pumping chamber. The fuel pump further comprises a supply passage, whereby fuel from the first pumping chamber is supplied to the second pumping chamber. A drive arrangement is provided for driving the first and second pumping plungers in both an extending direction and a retracting direction such that when the drive arrangement drives the first pumping plunger in its retracting direction, the second pumping plunger is driven in its extending direction to expel fuel from the second pumping chamber, and when the drive arrangement drives the first pumping plunger in its extending direction, the second pumping plunger is driven in its retracting direction and fuel is expelled from the first pumping chamber through the supply passage to the second pumping chamber.

26 Claims, 3 Drawing Sheets

FUEL PUMP

TECHNICAL FIELD

This invention relates to a fuel pump. In particular the invention relates to a pump for use in a fuel system for an engine of the compression ignition type. The fuel pump of the invention is particularly suitable for use in a common rail type fuel system. It will be appreciated, however, that the pump is also suitable for use in other applications.

BACKGROUND OF INVENTION

In a common rail fuel system, a high pressure fuel pump is used to charge a common rail to a high pressure. A plurality of individually actuable fuel injectors are arranged to control the supply of fuel from the common rail to the combustion spaces of an engine. The fuel pump is typically a cam actuated plunger pump.

Difficulties have been faced in achieving filling of the pump chambers of the pump in the time available, particularly where the flow of fuel to the pump is metered, and as a result a feed pump, conveniently located in the fuel tank, or a transfer pump has often been provided. Such transfer or feed pumps increase the cost and complexity of the fuel system and result in the system being of increased dimensions. In order to increase the range of applications for which a pump may be used, it is thought to be important to minimise the axial length of the pump.

is an object of the invention to provide a fuel pump in which the provision of a separate transfer or feed pump can be avoided. It is a further object to provide a fuel pump of relatively short axial extent.

SUMMARY OF THE INVENTION

According to the present invention there is provided a fuel pump comprising a first pumping plunger reciprocable within a first bore and defining, with the first bore, a first pumping chamber, a second pumping plunger reciprocable within a second bore and defining, with the second bore, a second pumping chamber, a supply passage whereby fuel from the first pumping chamber is supplied to the second pumping chamber, and drive means for driving the plungers in both an extending direction and a retracting direction such that when the drive means drives the first plunger in its retracting direction, the second plunger is driven in its extending direction to expel fuel from the second pumping chamber, and when the drive means drives the first plunger in its extending direction, the second plunger is driven in its retracting direction and fuel is expelled from the first pumping chamber through the supply passage to the second pumping chamber.

By using a first reciprocable plunger to charge a second pumping chamber in this manner, the provision of a separate transfer or feed pump can be avoided.

The first and second plungers are conveniently axially aligned. The plungers are conveniently driven by a common cam arrangement and are conveniently interconnected. Such an arrangement permits the axial extent of the pump to be reduced.

Alternatively, the first and second plungers may be spaced apart in the axial direction of the pump. In such an arrangement, the plungers are conveniently driven by separate cam arrangements, a pivotable drive member being used to drive the plungers in the retracting direction.

In a preferred embodiment of the present invention, the drive means comprise first and second tappet members associated with the first and second pumping plungers respectively, the first and second tappet members being reciprocable within first and second tappet bores respectively, the first and second tappet members defining, together with the respective tappet bore, first and second further chambers, the volumes of the first and second further chambers varying, in use, as the tappet members reciprocate within their respective tappet bores, the first and second further chambers being provided with vent means for venting the first and second chambers so as to substantially prevent reciprocating movement of the first and second tappet members being impaired.

Conveniently, the pump may further comprise means for permitting air to be drawn into the first and second further chambers.

The pump preferably comprises a metering arrangement for controlling the quantity of fuel supplied to the first and second pumping chambers.

Conveniently, the pump comprises a filling passage through which fuel flows into the first pumping chamber, the metering arrangement being provided within the filling passage, and an accumulator for fuel being provided to assist filling of the first pumping chamber.

According to another aspect of the invention there is provided a fuel pump comprising a pumping plunger reciprocable within a bore and a drive arrangement for driving the pumping plunger in both an extending direction and in a retracting direction, wherein the drive arrangement comprises a rotatable cam and a pair of cam followers coupled to one another and to the pumping plunger.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
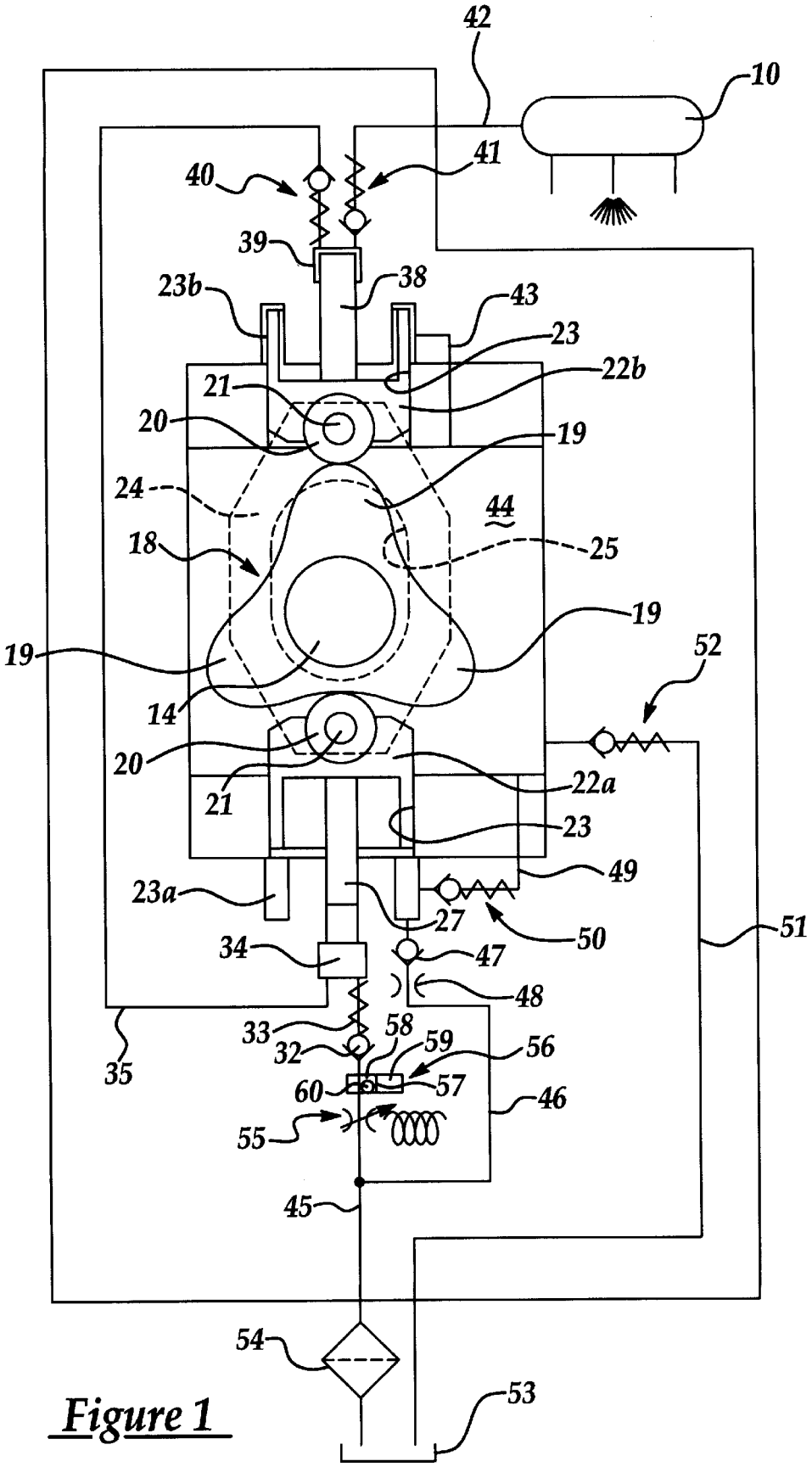
FIG. 1 is a diagrammatic view of a fuel pump in accordance with an embodiment of the invention.

The fuel pump illustrated in the accompanying drawings is intended for use in charging a common rail 10 to a suitably high pressure to be used in a fuel system for supplying fuel to a compression ignition internal combustion engine. The fuel pump comprises a multi-part pump body 11 including first and second parts 12, 13 which are secured to one another and which support a drive shaft 14 for rotation through bearings 15. Seals 16 are provided to avoid leakage of oil or other lubricants from the pump body 11. As illustrated most clearly in FIG. 1, the drive shaft 14 is shaped to define an integral cam 18 which includes three equiangularly spaced cam lobes 19.

The cam surface of the cam 18 is engaged by a pair of rollers 20 which are rotatably mounted upon pins 21 carried by respective tappets 22*a*, 22*b*. The tappets are each slidably mounted within respective bores 23 provided in the part 11 of the pump body 11. As illustrated, the pins 21 are secured to the tappets by virtue of the pins 21 extending through openings provided in the tappets.

Figure 3:
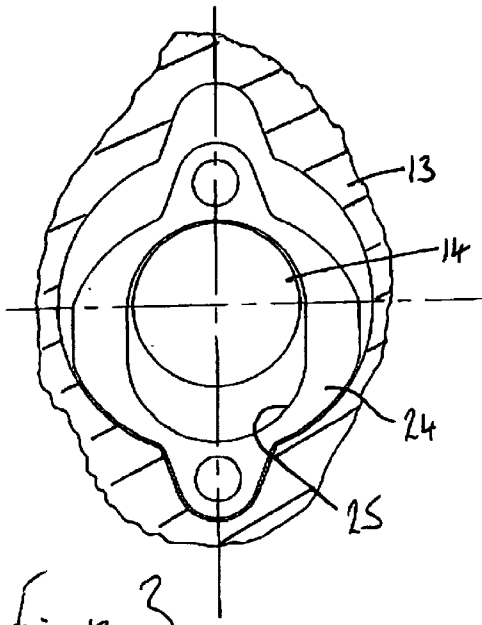
FIG. 3 is a diagram illustrating the relative locations of some of the parts of t he fuel pump.

The pins 21 further extend through openings provided in a pair of drive plates 24, the drive plates 24 interconnecting the pins 21, and thus interconnecting the tappets. As illustrated in FIG. 3, the drive plates 24 are provided with elongate slots 25 through which the drive shaft 14 extends, the slots 25 being of sufficient length to ensure that reciprocating motion of the tappets under the action of the cam 18 upon rotation of the drive shaft 14 is not impeded. The plates 24 and the interior of the pump body 11 are shaped such that engagement does not occur between the plates and the pump body in such a manner as to inhibit movement of the tappets. The plates 24 may be secured in position using clips, or may be held in position by the proximity of the pump body 11.

Figure 2:
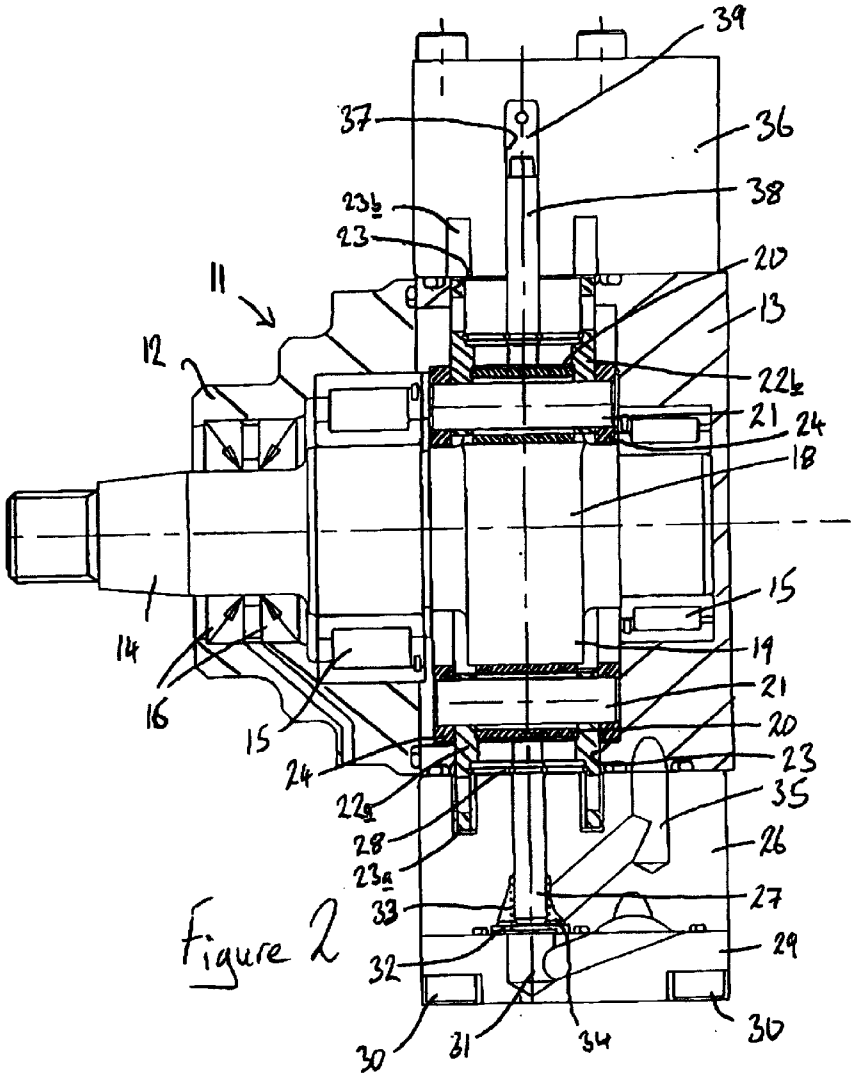
FIG. 2 is a sectional view of the fuel pump illustrated diagrammatically in FIG. 1.

As illustrated in FIG. 2, the part 13 of the pump body 11 has secured thereto a first plunger housing 26 provided with a bore within which a first plunger 27 is reciprocable. The first plunger 27 is secured to one of the tappets 22*a* such that motion of the tappet 22*a* is transmitted to the first plunger 27 to cause the plunger 27 to reciprocate within its bore. The coupling between the first plunger 27 and the associated tappet 22*a* is achieved through a spring clip arrangement 28 such that, in the event that the first plunger 27 becomes seized in position, relative motion can occur between the first plunger 27 and the associated tappet 22*a*. However, in normal use, the spring clip arrangement 28 secures the first plunger 27 rigidly to the tappet 22*a*.

The bore within which the first plunger 27 is reciprocable is closed by means of a cap 29 which is secured to the first plunger housing 26, the first plunger housing 26 and cap 29 being secured to the part 13 of the pump body 11 by means of bolts 30. It will be appreciated, however, that any alternative suitable technique could be used to secure these components to one another. Appropriate seals are located between these components of the fuel pump.

The cap 29 is provided with drillings defining an inlet passage 31 which communicates with an inlet port. Communication between the inlet passage 31 and the bore provided in the first plunger housing 26 is controlled by means of an inlet valve arrangement comprising a valve member 32 which is biased by means of a light spring 33 to a position in which it closes the end of the inlet passage 31. The spring prevents return flow of fuel, in use. The valve member 32 is in the form of a disc of diameter sufficient to cover the end of the inlet passage 31, the disc being provided with three radially extending legs of sufficient length to cooperate with the wall of the bore provided in the first plunger housing 26 to ensure that the valve member 32 remains substantially coaxial with the bore, in use. The spaces between the arms define a flow passage whereby fuel can flow to the bore when the valve member 32 is lifted away from the cap 29.

The inlet valve arrangement is designed to offer very little resistance to fuel flow, thereby permitting filling of the bore without requiring the provision of a lift pump. In order to permit this, the cross-sectional areas presented to fuel flow are large and the spring is light. The valve is conveniently able to open when the pressure difference across the valve is as low as 0.1 bar.

The bore provided in the first plunger housing 26, the first plunger 27 and the cap 29 together defme a first pumping chamber 34 which communicates with a supply passage 35 whereby fuel can be supplied from the first pumping chamber 34.

Diametrically opposite the first plunger housing 26, the part 13 is provided with a second plunger housing 36 which is secured to the part 13 by means of bolts. The second plunger housing 36 is provided with a blind bore 37 within which a second plunger 38 is reciprocable. The second plunger 38 is secured to the tappet 22*b* by means of a spring clip arrangement. The second plunger housing 36 and second plunger 38 together define a second, high pressure pumping chamber 39 which communicates through suitable drillings with the supply passage 35. As illustrated diagrammatically in FIG. 1, the supply passage 35 is provided with a non-return valve 40 such that fuel is able to flow from the first pumping chamber 34 through the supply passage 35 to the second pumping chamber 39, fuel flow in the reverse direction being substantially prohibited by means of the non-return valve 40. The second pumping chamber 39 further communicates through a second non-return valve 41 with a passage 42 which opens into the common rail 10. The non-return valve 41 is orientated such that fuel is permitted to flow from the second pumping chamber 39 towards the common rail 10, but to substantially prevent fuel flow in the reverse direction.

In order to minimise dead volume, thereby reducing fuel compressibility and improving the pump efficiency, the valve 40 is located adjacent the high pressure pumping chamber. The valve 40 forms a significant restriction to fuel flow as, in order to improve pump efficiency, the passage defined by the valve 40, when open, is small and the permitted lift of the valve member is small. The valve 40 contains a strong spring in order to ensure rapid closure. It will be appreciated, therefore, that an appreciable pressure difference is required to open the valve 40 and fill the high pressure pumping chamber.

It will be appreciated that the bores 23 within which the tappets are reciprocable defme chambers 23*a*, 23*b*, the volumes of which vary during reciprocating movement of the tappets. The chamber 23*b* associated with the tappet 22*b* with which the second pumping plunger 39 is associated is vented through a passage 43 to a chamber 44 within which the,cam 18 is rotatable. The venting of the chamber 23*b* in this manner ensures that reciprocating motion of the tappet 22*b* is not impaired.

The chamber 23*a* associated with the tappet 22*a* may be vented to the chamber 44 in the same manner, if desired. However, rather than simply vent the chamber 23*a* to the chamber 44, in the arrangement illustrated, the chamber 23*a* associated with the tappet 22*a* with which the first pumping chamber 27 is associated is used to draw air from a passage 45 which is connected to the inlet port of the pump. This is achieved by providing a passage 46 which connects the passage 45 to the chamber 23*a*, and by providing a passage 49, including a spring biased non-return valve 50, to provide a connection between the chamber 23*a* and the chamber 44. A non-return valve 47 and a restrictor 48 are provided in the passage 46. The non-return valve 47 is not spring biased and it is thought that, in use, air within the passages 45, 46 will be able to pass the valve 47, to flow towards the chamber 23*a* associated with the tappet 22*a* relatively easily. The flow of fuel past the valve 47 is restricted both by the valve 47 and by the restrictor 48 and, thus, relatively little fuel will flow to the chamber 23*a* associated with the tappet 22*a*.

The chamber 44 communicates through a drain line 51 within which a non-return valve 52 is provided with a fuel reservoir 53. The fuel reservoir 53 further communicates through a filter 54 with the passage 45.

In use, starting from the position illustrated in FIG. 2 in which first pumping plunger 27 occupies an extended position in which the first pumping chamber 34 is of relatively small volume, and in which the second pumping plunger 38 occupies a retracted position in which the second pumping chamber 39 is of relatively large volume, rotation of the drive shaft 14 and cam 18 causes the roller 20 associated with the second pumping plunger 39 to move into engagement with one of the cam lobes 19, the cooperation between the cam lobe 19 and the roller 20 causing the roller 20, the associated tappet 22*b* and the second pumping plunger 38 to move from the retracted position illustrated in FIG. 2 towards an extended position as illustrated in FIG. 1. Such motion of the second pumping plunger 38 compresses the fuel within the second pumping chamber 39. As the non-return valve 40 prevents fuel flow from the second pumping chamber 39 towards the first pumping chamber 34, fuel is unable to escape towards the first pumping chamber 34, and instead fuel is supplied through the non-return valve 41 and passage 42 to the common rail 10. The motion of the roller 20 associated with the second pumping plunger 38 is transmitted through the drive plates 24 to the tappet 22*a* associated with the first pumping plunger 27. As a result, the first pumping plunger 27 is caused to move from its extended position towards its retracted position as illustrated in FIG. 1. Such motion of the first pumping plunger 27 increases the volume of the first pumping chamber 34, reducing the fuel pressure therein. As described hereinbefore, the non-return valve 40 prevents fuel flow to the first pumping chamber 34 along the supply passage 35. As a result, the fuel pressure within the first pumping chamber 34 falls to a level sufficient to cause the valve member 32 to move away from its seating against the action of the spring 33, and fuel is drawn into the first pumping chamber 34 from the fuel reservoir 53 through the filter 54 and a metering arrangement 55 which is conveniently of electromagnetically controlled form.

The motion of the first and second pumping plungers 27, 38 continues until the position illustrated in FIG. 1 is reached. In this position, the first pumping plunger 27 occupies its retracted position and the second pumping plunger 38 occupies its extended position. Once this position has been reached, continued rotation of the drive shaft 14 and cam 18 causes the roller associated with the first pumping plunger 27 to move into engagement with one of the cam lobes 19, the cooperation therebetween causing the pumping plunger 27 to commence movement towards its extended position. As the valve member 32 is biased to a closed position, conveniently by a light spring, such movement pressurizes the fuel within the first pumping chamber 34, and thereafter fuel is supplied through the supply passage 35 from the first pumping chamber 34 towards the second pumping chamber 39. The movement of the roller 20 associated with the first pumping plunger 27 is transmitted through the drive plates 24 to the tappet 22*b* associated with the second pumping plunger 38 and, as a result, the second pumping plunger 38 is moved towards its retracted position, increasing the volume of the second pumping chamber 39 at a rate sufficient to accommodate the fuel being supplied from the first pumping chamber 34. Fuel flow continues in this manner until the first and second pumping plungers 27, 38 have returned to the position shown in FIG. 2. Once the position illustrated in FIG. 2 has been achieved, continued rotation of the drive shaft 14 results in the expulsion of further fuel from the second pumping chamber 39 as described hereinbefore.

As mentioned hereinbefore, the valve 40 requires the application of an appreciable load to open and allow filling of the high pressure pumping chamber. As the plunger 27 is driven by the same drive arrangement as the plunger 38, it will be appreciated that a large pumping load can be applied and that it will be sufficient to open the valve 40 to fill the high pressure pumping chamber. Furthermore, there is no need to provide any system for regulating the pressure at the outlet of the low pressure pumping chamber.

The motion of the tappet 22*a* associated with the first pumping plunger 27 also serves to draw fuel and air from the passage 45 through the passage 46, restrictor 48 and valve 47, and to expel fuel and air through the valve 50 to the chamber 44 from where it is returned through the line 51 to the fuel reservoir 53. Such motion of the tappet 22*a* is useful in that, upon initial start-up of the fuel pump where a significant quantity of air may be present in the passages 45, 46, the motion of the tappet 22*a* will assist in quickly venting such air from the system, rapidly charging the passage 45 with fuel. After initial start-up of the fuel pump, it is hoped that little or no air will be present in the passage 45. The swept volume of the chamber 23*a* is large. However, only a small fraction of this volume becomes filled with fuel in normal use as the restrictor 48 and valve 47 form restrictions to fuel flow to the chamber 23*a*, thus the efficiency of the pump is not significantly impaired by the movement of the tappet 22*a* having to displace excessive amounts of fuel. The fuel which is drawn from the passage 45 in this manner serves to lubricate the pump.

The metering arrangement 55 is used to control the quantity of fuel which is supplied to the first pumping chamber 34, and hence the quantity of fuel supplied to the second pumping chamber 39, thereby controlling the fuel supply rate to the common rail 10 and permitting control of the common rail pressure. Where the fuel pump is operating at high speeds, the metering arrangement 55 forms a significant restriction to the rate at which fuel is able to flow to the first pumping chamber 34, and the fuel pressure therein may fall below the threshold at which dissolved air is released from the fuel during the retraction of the first pumping plunger 27. As the first pumping plunger 27 returns to its extended position, the fuel pressure within the first pumping chamber 34 will be restored to a sufficient extent that the air bubbles will collapse and be reabsorbed into the fuel. The first pumping plunger 27 is conveniently of diameter slightly larger than that of the second pumping plunger 38 to compensate for the changes in the effective density of the fuel which occur when air is released therefrom. Where the fuel pump is operating at low speeds, the metering arrangement 55 forms a smaller restriction to fuel flow and the fuel pressure within the pumping chamber 34 will not fall to such an extent. As a result, the risk of the formation of air bubbles within the fuel is reduced. Where the first pumping plunger 27 is of diameter greater than the second pumping plunger 38, excess fuel supplied from the first pumping chamber 34 will either escape between the first pumping plunger 27 and its bore, between the second pumping plunger 38 and its bore or will serve to pressurize the fuel in the second pumping chamber 39 prior to movement of the second pumping plunger 38 in its extending direction.

Where the passage 45 is relatively long, the inertia of the fuel may be sufficient to prevent filling of the low pressure pumping chamber in the time available. In order to assist in filling, an accumulator 56 may be provided close to the metering arrangement 55 and the inlet valve arrangement to smooth the fuel flow rate along the passage 45 and to increase the pressure difference across the metering arrangement 55. The accumulator 56 conveniently comprises a chamber divided by a diaphragm 57 into first and second sub-chambers 58, 59. The first sub-chamber 58 is connected to the passage 45, the second sub-chamber 59 being vented to the atmosphere. A spring 60 is provided to urge the diaphragm 57 lightly in a direction tending to draw fuel into the first sub-chamber 58 when the inlet valve is closed, opening of the inlet valve when fuel is to be drawn into the low pressure pumping chamber allowing the diaphragm 57 to move to expel fuel from the first sub-chamber 58.

It will be appreciated that in the arrangement illustrated, it is important that the cam 18 is provided with an odd number of equally spaced cam lobes such that when one of the pumping plungers occupies its extended position, the other pumping plunger occupies its retracted position. The cam lobes are conveniently profiled such that at all times, the first pumping plunger 27 moves at the same speed as the second pumping plunger 38. The lobes are conveniently of sinusoidal profile, but lobes shaped to cause a generally constant rate of plunger movement may be used, and may reduce the required maximum drive torque. In order to compensate for slight variations in the component dimensions, the rollers 20 may be of graded size, selected to reduce backlash. If desired, one of the roller and tappet arrangements may be spring loaded towards the cam 18. Such spring loading may compensate for slight dimensional variations due to manufacturing tolerances.

The pump described hereinbefore is advantageous in that it is of relatively short axial extent and thus can be used in a wide range of applications. Additionally, as the pump of the present invention incorporates a pump to supply fuel to the main pumping chamber, the requirement to provide an additional feed or transfer pump is avoided. The output of the 'transfer pump' is substantially matched to the requirement of the 'high pressure pump' at all times thus improving the efficiency of the pump. The pump is of relatively simple design and so is relatively inexpensive.

It will be appreciated that the inlet metering arrangement may take any suitable form, and that the invention is not restricted to the arrangement illustrated. Further, it will be appreciated that the pump may be modified to incorporate an alternative mechanism to move the plungers in the retracting direction, for example a hydraulic return arrangement.

Figure 4:
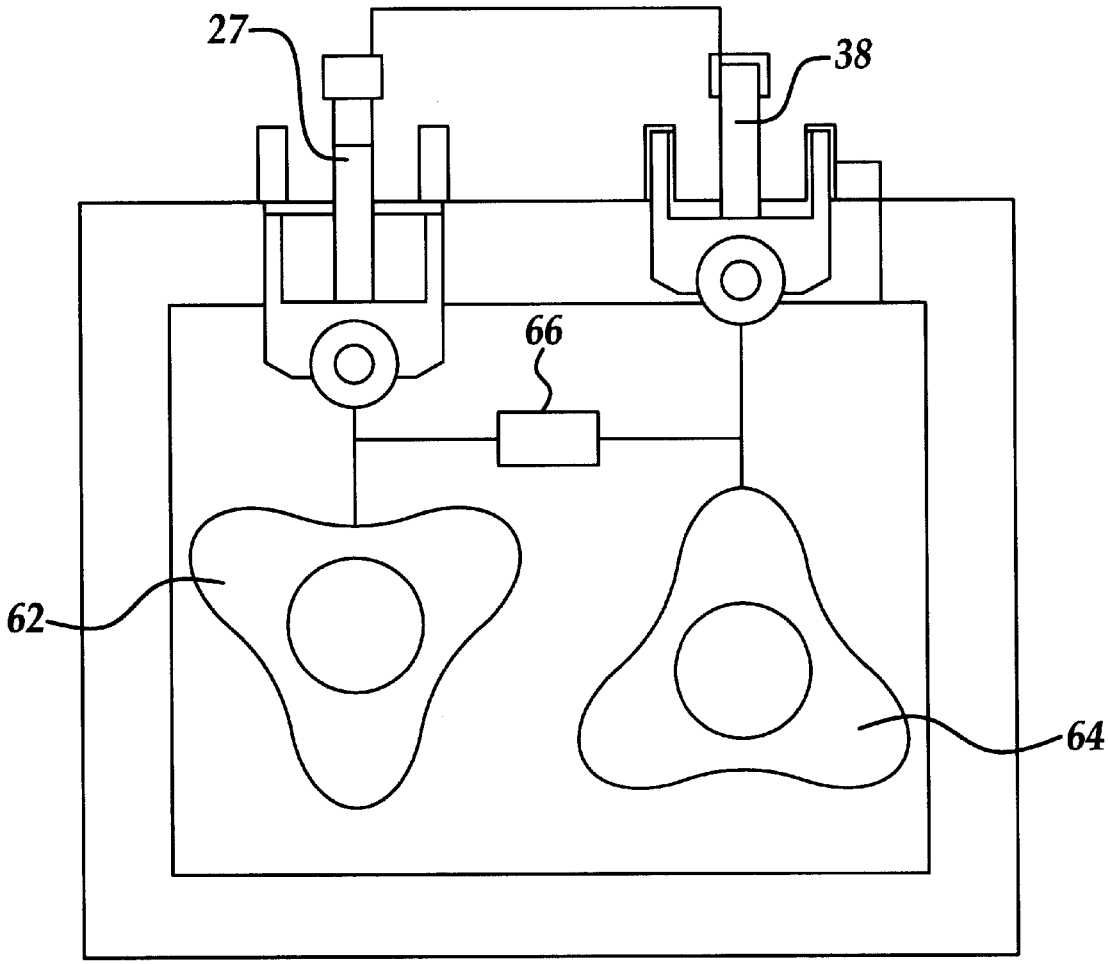

Although in the description hereinbefore, the pumping plungers are coaxial and are spaced diametrically from one another relative to the axis of the drive shaft 14, it will be appreciated that, if desired, the plungers 27, 38 could be located adjacent one another and driven by separate cams 62, 64, as shown in FIG. 4. In such an arrangement, the movement of each plunger 27, 38 from its extended position towards its retracted position is conveniently achieved using a rocking lever 66. Such an arrangement does not require the provision of a cam having an odd number of lobes, the requirement simply being that the cams 62, 64 provide fully matched motion such that both the speed and displacement of both plungers are equal and opposite.

What is claimed is:

1. A fuel pump comprising:

a first pumping plunger reciprocable within a first bore and defining, with the first bore, a first pumping chamber;

a second pumping plunger reciprocable within a second bore and defining, with the second bore, a second pumping chamber;

a supply passage whereby fuel from the first pumping chamber is supplied to the second pumping chamber;

a drive arrangement for driving the first and second pumping plungers in both an extending direction and a retracting direction such that when the drive arrangement drives the first pumping plunger in its retracting direction, the second pumping plunger is driven in its extending direction to expel fuel from the second pumping chamber, and when the drive arrangement drives the first pumping plunger in its extending direction, the second pumping plunger is driven in its retracting direction and fuel is expelled from the first pumping chamber through the supply passage to the second pumping chamber; and wherein the drive arrangement comprises first and second tappet members associated with the first and second pumping plungers respectively, the first and second tappet members being reciprocable within first and second tappet bores respectively, the first and second tappet members defining, together with the respective tappet bore, first and second further chambers, the volumes of the first and second further chambers varying, in use, as the tappet members reciprocate within their respective tappet bores, the first and second further chambers being provided with a vent arrangement for venting the first and second chambers so as to substantially prevent reciprocating movement of the first and second tappet members being impaired.

2. The fuel pump as claimed in claim 1, wherein the first and second pumping plungers are axially aligned.

3. The fuel pump as claimed in claim 2, wherein the drive arrangement comprises a common cam arrangement arranged to drive both the first and second pumping plungers.

4. The fuel pump as claimed in claim 2, wherein the first and second pumping plungers are interconnected.

5. The fuel pump as claimed in claim 1, wherein the first and second pumping plungers are axially spaced.

6. The fuel pump as claimed in claim 5, wherein the drive arrangement comprises first and second cam arrangements arranged to drive the first and second pumping plungers respectively.

7. The fuel pump as claimed in claim 6, wherein the drive arrangement further comprises a pivotable drive member for driving the first and second pumping plungers in their retracting directions.

8. The fuel pump as claimed in claim 1, wherein the supply passage is provided with a valve arrangement which is arranged to permit fuel flow from the first pumping chamber to the second pumping chamber and to substantially prevent fuel flow from the second pumping chamber to the first pumping chamber.

9. The fuel pump as claimed in claim 1, wherein the first pumping chamber has, associated therewith, a further arrangement for permitting air to be drawn into the first further chamber.

10. The fuel pump as claimed in claim 1, further comprising a metering arrangement for controlling the quantity of fuel supplied to the first and second pumping chambers.

11. The fuel pump as claimed in claim 10, comprising a filling passage through which fuel flows into the first pumping chamber, the metering arrangement being provided within the filling passage, and further comprising an accumulator for fuel to assist filling of the first pumping chamber.

12. The fuel pump as claimed in claim 1, wherein the first pumping plunger has a larger diameter than the second pumping plunger.

13. A fuel pump comprising:

a pumping plunger reciprocable within a bore;

a drive arrangement for driving the pumping plunger in both an extending direction and in a retracting direction;

wherein the drive arrangement comprises a rotatable cam, a pair of cam followers coupled to one another and to the pumping plunger, and a tappet member associated with the pumping plunger, the tappet member being reciprocable within a tappet bore, the tappet member defining, together with the tappet bore a chamber, the volume of the chamber varying, in use, as the tappet member reciprocates within the tappet bore, the chamber being provided with a vent arrangement for venting the chamber so as to substantially prevent reciprocating movement of the tappet member from being impaired.

14. A fuel pump comprising:

a first pumping plunger reciprocable within a first bore and defining, with the first bore, a first pumping chamber;

a second pumping plunger reciprocable within a second bore and defining, with the second bore, a second pumping chamber;

a supply passage whereby fuel from the first pumping chamber is supplied to the second pumping chamber;

a drive arrangement positioned within a drive chamber for driving the first and second pumping plungers in both an extending direction and a retracting direction such that when the drive arrangement drives the first pumping plunger in its retracting direction, the second pumping plunger is driven in its extending direction to expel fuel from the second pumping chamber, and when the drive arrangement drives the first pumping plunger in its extending direction, the second pumping plunger is driven in its retracting direction and fuel is expelled from the first pumping chamber through the supply passage to the second pumping chamber; and a first vent arrangement associated with said first bore and a second vent arrangement associated with said second bore, wherein said first and second vent arrangements are vented to said drive chamber so as to substantially prevent reciprocating movement of the first and second pumping plungers from being impaired.

15. The fuel pump as claimed in claim 14, wherein the first and second pumping plungers are axially aligned.

16. The fuel pump as claimed in claim 15, wherein the drive arrangement comprises a common cam arrangement arranged to drive both the first and second pumping plungers.

17. The fuel pump as claimed in claim 15, wherein the first and second pumping plungers are interconnected.

18. The fuel pump as claimed in claim 14, wherein the first and second pumping plungers are axially spaced.

19. The fuel pump as claimed in claim 18, wherein the drive arrangement comprises first and second cam arrangements arranged to drive the first and second pumping plungers respectively.

20. The fuel pump as claimed in claim 19, wherein the drive arrangement further comprises a pivotable drive member for driving the first and second pumping plungers in their retracting directions.

21. The fuel pump as claimed in claim 14, wherein the supply passage is provided with a valve arrangement which is arranged to permit fuel flow from the first pumping chamber to the second pumping chamber and to substantially prevent fuel flow from the second pumping chamber to the first pumping chamber.

22. The fuel pump as claimed in claim 14, wherein the drive arrangement comprises first and second tappet members associated with the first and second pumping plungers respectively, the first and second tappet members being reciprocable within first and second tappet bores respectively, the first and second tappet members defining, together with the respective tappet bore, first and second further chambers, the volumes of the first and second further chambers varying, in use, as the tappet members reciprocate within their respective tappet bores, the first further chamber being provided with the first vent arrangement and the second further chamber being provided with the second vent arrangement.

23. The fuel pump as claimed in claim 22, wherein the first pumping chamber has, associated therewith, a further arrangement for permitting air to be drawn into the first further chamber.

24. The fuel pump as claimed in claim 14, further comprising a metering arrangement for controlling the quantity of fuel supplied to the first and second pumping chambers.

25. The fuel pump as claimed in claim 24, comprising a filling passage through which fuel flows into the first pumping chamber, the metering arrangement being provided within the filling passage, and further comprising an accumulator for fuel to assist filling of the first pumping chamber.

26. The fuel pump as claimed in claim 14, wherein the first pumping plunger has a larger diameter than the second pumping plunger.

* * * * *